US008988476B2

(12) United States Patent
Haginoya

(10) Patent No.: US 8,988,476 B2
(45) Date of Patent: Mar. 24, 2015

(54) EXPOSURE DEVICE AND IMAGE FORMING APPARATUS HAVING A LIGHT SOURCE POSITIONING MEMBER AND AN ELASTICALLY DEFORMABLE BOARD

(71) Applicant: Fuji Xerox Co., Ltd., Tokyo (JP)

(72) Inventor: Yoshiaki Haginoya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/100,685

(22) Filed: Dec. 9, 2013

(65) Prior Publication Data

US 2014/0362153 A1 Dec. 11, 2014

(30) Foreign Application Priority Data

Jun. 7, 2013 (JP) ..... 2013-121182

(51) Int. Cl.
*B41J 2/435* (2006.01)
*B41J 2/47* (2006.01)
*G03G 15/04* (2006.01)

(52) U.S. Cl.
CPC ..... *G03G 15/04* (2013.01)
USPC ..... 347/237; 347/247

(58) Field of Classification Search
USPC ..... 347/237, 242, 245, 247, 257, 263
See application file for complete search history.

(56) References Cited

U.S. PATENT DOCUMENTS 7,800,641 B2 * 9/2010 Kubo et al. ..... 347/245
2011/0115869 A1 5/2011 Nakaie

FOREIGN PATENT DOCUMENTS

JP 2004006592 A * 1/2004 ..... H01S 5/022
JP A-2004-6592 1/2004
JP A-2011-104867 6/2011

* cited by examiner

*Primary Examiner* — Hai C Pham
(74) *Attorney, Agent, or Firm* — Oliff PLC

(57) ABSTRACT

An exposure device includes a board on which a light source for emitting a light beam is mounted and on which a circuit is disposed, a housing that contains an optical system for guiding the light beam, a positioning member that positions the light source relative to the housing in an optical axis direction by contacting a reference portion disposed around the light source, and a deformable portion disposed in a region of the board that is different from a region on which the circuit is disposed. The deformable portion urges the reference portion toward the positioning member by being elastically deformed when the board is attached to the housing.

6 Claims, 11 Drawing Sheets

EXPOSURE DEVICE AND IMAGE FORMING APPARATUS HAVING A LIGHT SOURCE POSITIONING MEMBER AND AN ELASTICALLY DEFORMABLE BOARD

CROSS-REFERENCE TO RELATED APPLICATIONS

This application is based on and claims priority under 35 USC 119 from Japanese Patent Application No. 2013-121182 filed Jun. 7, 2013.

BACKGROUND

1. Technical Field

The present invention relates to an exposure device and an image forming apparatus including the exposure device.

2. Summary

According to an aspect of the invention, an exposure device includes a board on which a light source for emitting a light beam is mounted and on which a circuit is disposed, a housing that contains an optical system for guiding the light beam, a positioning member that positions the light source relative to the housing in an optical axis direction by contacting a reference portion disposed around the light source, and a deformable portion disposed in a region of the board that is different from a region on which the circuit is disposed. The deformable portion urges the reference portion toward the positioning member by being elastically deformed when the board is attached to the housing.

BRIEF DESCRIPTION OF THE DRAWINGS

Exemplary embodiments of the present invention will be described in detail based on the following figures, wherein.

DETAILED DESCRIPTION

Referring to FIGS. 1 to 11, an exposure device and an image forming apparatus according to exemplary embodiments of the present invention will be described. In the figures, an arrow H indicates the vertical direction, and an arrow W indicates a horizontal direction that is the width direction (of the image forming apparatus).

Overall Structure of Image Forming Apparatus

Figure 11:
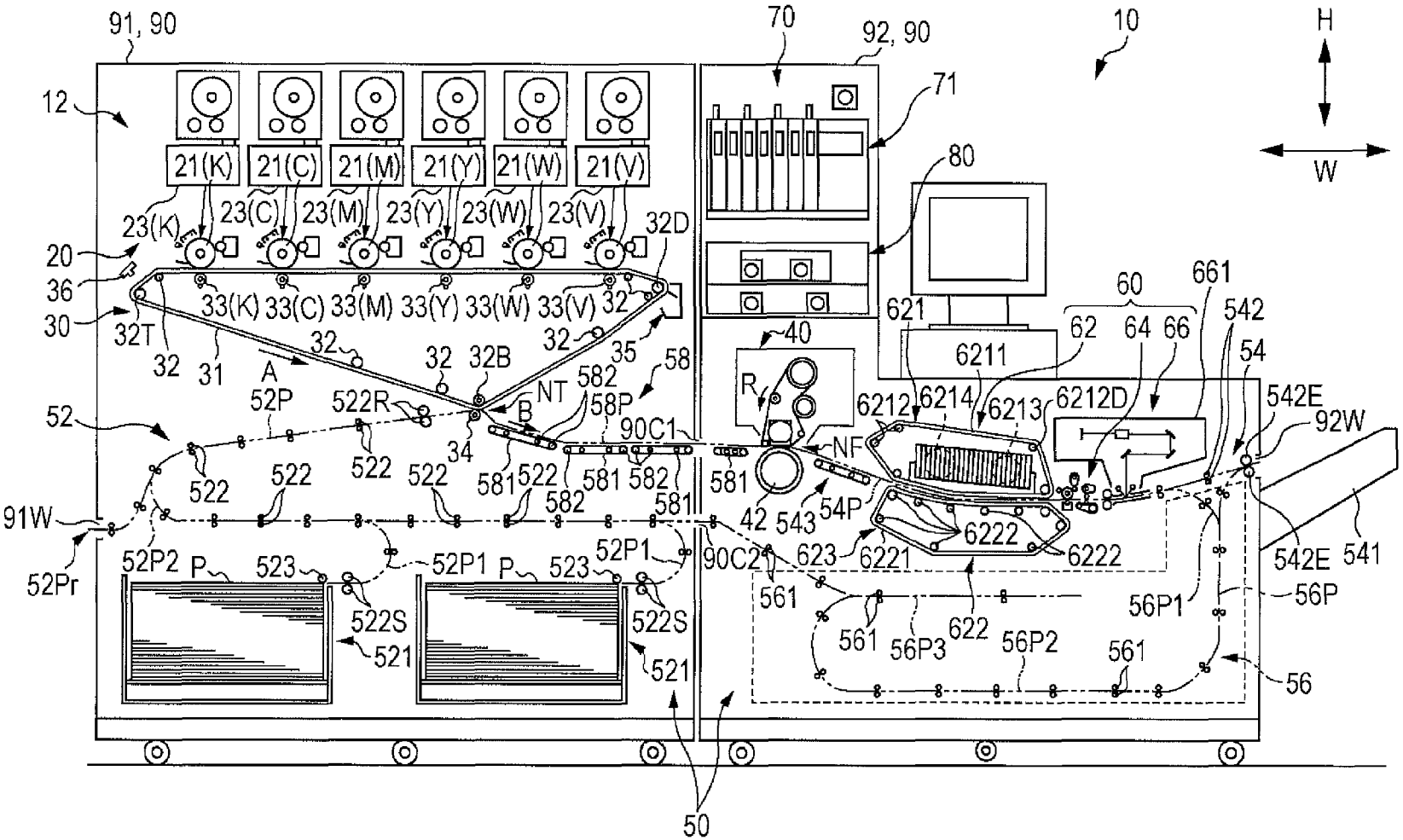
FIG. 11 is a schematic diagram illustrating the image forming apparatus according to the exemplary embodiment of the present invention.

FIG. 11 is a schematic front view illustrating the overall structure of an image forming apparatus 10. As illustrated in FIG. 11, the image forming apparatus 10 includes an image forming section 12, a medium transport device 50, and a postprocessing section 60. The image forming section 12 forms an image on a sheet P, which is an example of a recording medium, by using an electrophotographic method. The medium transport device 50 transports the sheet P. The postprocessing section 60 performs postprocessing on the sheet P, on which an image has been formed.

The image forming apparatus 10 further includes a controller 70 and a power supply unit 80. The controller 70 controls the aforementioned sections and the power supply unit 80. The power supply unit 80 supplies electric power to the aforementioned sections and to the controller 70.

The image forming section 12 includes toner-image forming portions 20, a transfer device 30, and a fixing device 40. The toner-image forming portions 20 form toner images. The transfer device 30 transfers the toner images formed by the toner-image forming portions 20 to a sheet P. The fixing device 40 fixes the toner images transferred to the sheet P onto the sheet P.

The medium transport device 50 includes a medium feeding portion 52 and a medium output portion 54. The medium feeding portion 52 feeds the sheet P to the image forming section 12. The medium output portion 54 outputs the sheet P on which toner images have been formed. The medium transport device 50 further includes a medium reversing portion 56 and an intermediate transport portion (described below). The medium reversing portion 56 is used when the image forming apparatus 10 forms images on both sides of the sheet P.

The postprocessing section 60 includes a medium cooling portion 62, a decurling device 64, and an image inspection portion 66. The medium cooling portion 62 cools the sheet P, to which the toner images have been transferred in the image forming section 12. The decurling device 64 decurls the sheet P. The image inspection portion 66 inspects the toner images formed on the sheet P. The components of the postprocessing section 60 are disposed in the medium output portion 54 of the medium transport device 50.

The components of the image forming apparatus 10 are contained in a housing 90, except for a medium output tray 541 of the medium output portion 54 of the medium transport device 50. In the present exemplary embodiment, the housing 90 has a two-part structure having a first housing 91 and a second housing 92, which are arranged side by side in the width direction. Thus, it is possible to divide the image forming apparatus 10 into small units in the width direction when transporting the image forming apparatus 10.

The first housing 91 contains the components of the image forming section 12 (excluding the fixing device 40 described below) and the medium feeding portion 52. The second housing 92 contains the fixing device 40 of the image forming section 12, the medium output portion 54 excluding the medium output tray 541, the medium cooling portion 62, the image inspection portion 66, the medium reversing portion 56, the controller 70, and the power supply unit 80. The first housing 91 and the second housing 92 are joined to each other by using fasteners, such as bolts and nuts (not shown). In this state, a connection opening 90C1 and a connection opening 90C2 are formed between the first housing 91 and the second housing 92. The sheet P is transported from a transfer nip NT (described below) of the image forming section 12 to a fixing nip NF (described below) through the connection opening 90C1. The sheet P is transported from the medium reversing portion 56 to the medium feeding portion 52 through the connection opening 90C2.

Image Forming Section

Figure 10:
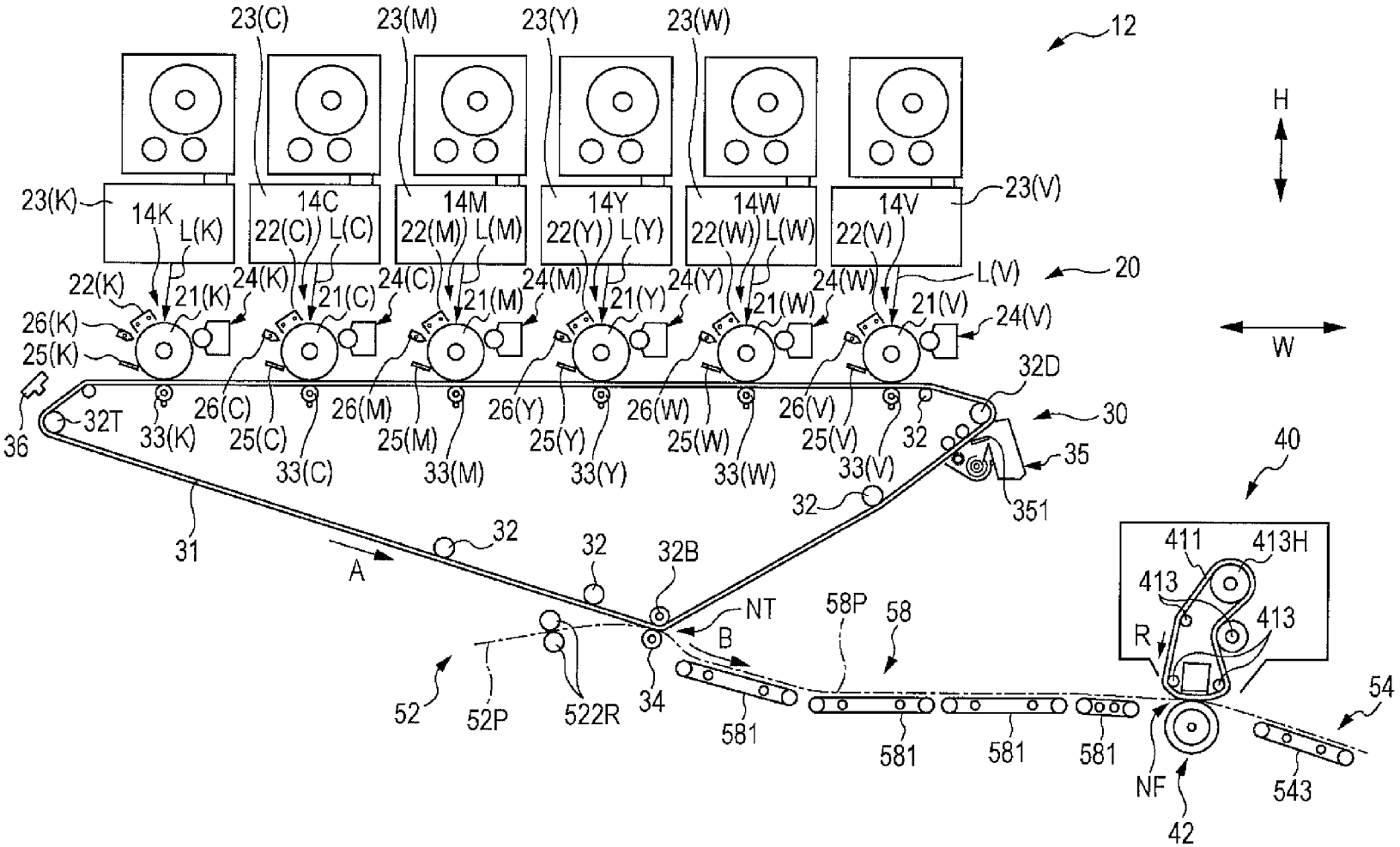
FIG. 10 is a schematic diagram illustrating toner image forming portions and other components of the image forming apparatus according to the exemplary embodiment of the present invention.

As described above, the image forming section 12 includes the toner-image forming portions 20, the transfer device 30, and the fixing device 40. The toner-image forming portions 20 form toner images of different colors. In the present exemplary embodiment, six toner-image forming portions 20 for a first special color (V), a second special color (W), yellow (Y), magenta (M), cyan (C), and black (K) are provided. The letters (V), (W), (Y), (M), (C), and (K) shown in FIG. 10 represent these colors. The transfer device 30 transfers toner images of six colors, which have been first-transferred to a transfer belt 31 in an overlapping manner, from the transfer belt 31 to a sheet P at the transfer nip NT (as described in detail below).

In the present exemplary embodiment, the first special color (V) and the second specific color (W) are, for example, corporate colors of a user, which are likely to be more frequently used than other colors.

Toner Image Forming Portion

Figure 9:
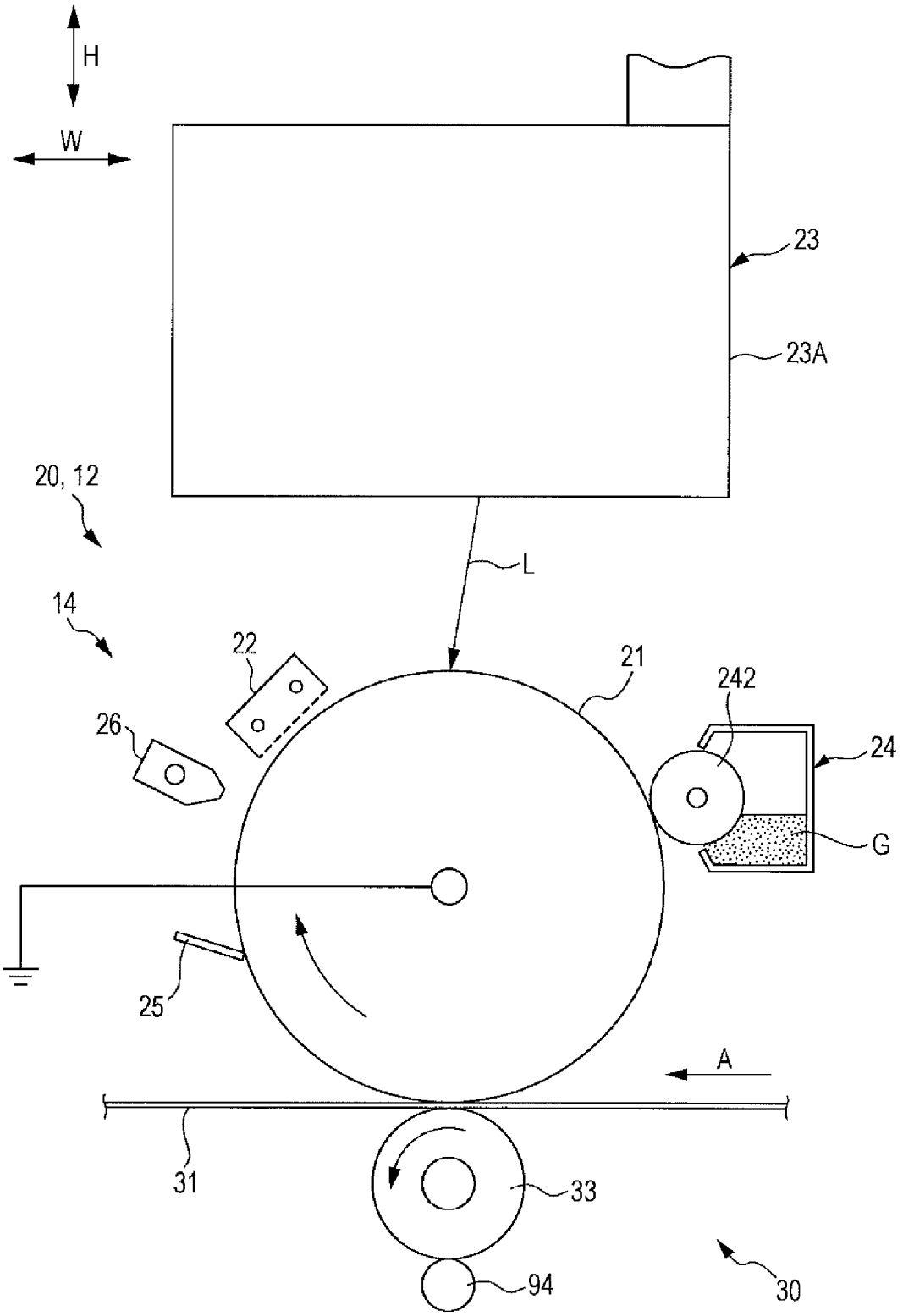
FIG. 9 is a schematic diagram illustrating an exposure device, a photoconductor drum, and other components of an image forming apparatus according to an exemplary embodiment of the present invention.

The toner-image forming portions 20 are basically the same except for the colors of toners they use. Therefore, in the following description, one of image forming units 14 will be described as an example. As illustrated in FIG. 9, the image forming unit 14 of the toner-image forming portion 20 includes a photoconductor drum 21, a charger 22, an exposure device 23, a developing device 24, a cleaning device 25, and a charge eliminating device 26. The photoconductor drum 21 is an example of an image carrying member, and the developing device 24 is an example of a developing unit.

Photoconductor Drum

The photoconductor drum 21 has a cylindrical shape, is grounded, and is rotated by a driving unit (not shown) around its own axis. A photosensitive layer is disposed on the surface of the photoconductor drum 21. The photosensitive layer is, for example, negatively charged. As illustrated in FIG. 10, the photoconductor drums 21 for different colors are arranged along a straight line extending in the width direction in a front view.

Charger

As illustrated in FIG. 9, the charger 22 negatively charges the surface of (the photosensitive layer of) the photoconductor drum 21. In the present exemplary embodiment, the charger 22 is a scorotron corona charger (non-contact charger).

Exposure Device

The exposure device 23 forms an electrostatic latent image on the surface of the photoconductor drum 21. To be specific, the exposure device 23 irradiates the surface of the photoconductor drum 21, which has been charged by the charger 22, with a light beam L that is modulated in accordance with image data received from an image signal processor 71 (see FIG. 11) of the controller 70. An electrostatic latent image is formed on the surface of the photoconductor drum 21 as the exposure device 23 irradiates the surface with the light beam L. The exposure device 23 will be described below in detail.

Developing Device

The developing device 24 forms a toner image on the surface of the photoconductor drum 21 by developing the electrostatic latent image on the surface of the photoconductor drum 21 with a developer G including a toner.

Cleaning Device

The cleaning device 25 is a blade that scrapes off the toner remaining on the surface of the photoconductor drum 21 after the toner image has been transferred to the transfer device 30.

Charge Eliminating Device

The charge eliminating device 26 eliminates static electricity by irradiating the photoconductor drum 21 with light after the transfer of the toner image. Thus, charges on the surface of the photoconductor drum 21 are eliminated.

Transfer Device

The transfer device 30 transfers (first-transfers) the toner images on the photoconductor drums 21 for different colors to the transfer belt 31 in an overlapping manner, and then transfers (second-transfers) the overlapping toner image to the sheet P. The transfer device 30 will be described below in detail.

Transfer Belt

As illustrated in FIG. 10, the transfer belt 31 is an endless belt that is looped over plural rollers 32 so as to form a certain shape. In the present exemplary embodiment, the transfer belt 31 forms an inverted obtuse triangular shape having a long side extending in the width direction in a front view. A roller 32D illustrated in FIG. 10, which is one of the rollers 32, functions as a driving roller that is driven by a motor (not shown) and that rotates the transfer belt 31 in the direction of an arrow A.

A roller 32T, which is one of the rollers 32 illustrated in FIG. 10, functions as a tension roller that applies a tension to the transfer belt 31. A roller 32B, which is one of the rollers 32 illustrated in FIG. 10, functions as an opposing roller for a second-transfer roller (described below). A portion of the transfer belt 31 corresponding to a lower vertex of the inverted obtuse triangular shape is looped the roller 32B. A portion of the transfer belt 31 corresponding to the upper side of the inverted triangular shape, which extends in the width direction, is in contact with lower portions of the photoconductor drums 21 for different colors from below.

First-Transfer Roller

First-transfer rollers 33 are disposed inside the loop of the transfer belt 31. The first-transfer rollers 33, which are examples of a transfer member, transfer the toner images on the photoconductor drums 21 to the transfer belt 31. Each of the first-transfer rollers 33 is disposed so as to face a corresponding one of the photoconductor drums 21 with the transfer belt 31 therebetween. A transfer bias voltage having a polarity opposite to that of the toner is applied to the first-transfer rollers 33. Due to the application of the transfer bias voltage, the toner images formed on the photoconductor drums 21 are transferred to the transfer belt 31.

Second-Transfer Roller

The transfer device 30 further includes the second-transfer roller 34 that transfers the overlapping toner image on the transfer belt 31 to the sheet P. The second-transfer roller 34 and the roller 32B are disposed with the transfer belt 31 therebetween, thereby forming the transfer nip NT between the second-transfer roller 34 and the transfer belt 31. The sheet P is supplied to this transfer nip NT at an appropriate timing from the medium feeding portion 52. A power supply unit (not shown) applies a transfer bias voltage, which has a polarity opposite to that of the toner, to the second-transfer roller 34. Due to the application of the transfer bias voltage, the toner images are transferred from the transfer belt 31 to the sheet P passing through the transfer nip NT.

Cleaning Device

The transfer device 30 further includes a cleaning device 35 that cleans the transfer belt 31 after the second-transfer operation is finished. With respect to the rotation direction of the transfer belt 31, the cleaning device 35 is disposed at a position on the downstream side of a region (the transfer nip NT) in which the second-transfer operation is performed and on the upstream side of the region in which the first-transfer operation is performed. The cleaning device 35 includes a blade 351 that scrapes off toner remaining on the surface of the transfer belt 31.

Fixing Device

The fixing device 40 fixes the toner images, which have been transferred to the sheet P by the transfer device 30, to the sheet P. In the present exemplary embodiment, the fixing device 40 fixes the toner images to the sheet P by heating and pressing the toner images at the fixing nip NF, which is formed between a pressure roller 42 and a fixing belt 411, which is looped around plural rollers 413. A roller 413H, which is one of the rollers 413, is a heating roller that contains, for example, a heater and that is rotated by a driving force transmitted from a motor (not shown). Thus, the fixing belt 411 is rotated in the direction of an arrow R.

The pressure roller 42 is rotated at the same peripheral velocity as the fixing belt 411 by a driving force transmitted from a motor (not shown).

Medium Transport Device

As illustrated in FIG. 11, the medium transport device 50 includes the medium feeding portion 52, the medium output portion 54, the medium reversing portion 56, and the intermediate transport portion 58.

Medium Feeding Portion

The medium feeding portion 52 includes containers 521 each containing a stack of sheets P. In the present exemplary embodiment, two containers 521 are disposed below the transfer device 30 so as to be arranged side-by-side in the width direction.

A medium feeding path 52P is formed by plural transport roller pairs 522, guides (not shown), and the like so as to extend from the containers 521 to the transfer nip NT, where the second-transfer operation is performed. The medium feeding path 52P includes two turning portions 52P1 and 52P2 at which the direction of the medium feeding path 52P is turned in the width direction. The entirety of the medium feeding path 52P has a substantially S-shape extending upward to the transfer nip NT.

A feeding roller 523 is disposed in an upper portion of each of the containers 521. Each of the feeding rollers 523 feeds an uppermost one of the sheets P stacked in the containers 521. Transport roller pairs 522S are two of the transport roller pairs 522 that are located on the most upstream side in the sheet-transport direction. The transport roller pairs 522S function as separation rollers that separate the sheets P that are fed in an overlapping manner from the containers 521 by the feeding rollers 523. A transport roller pair 522R is one of the transport roller pairs 522 that is located at a position immediately upstream of the transfer nip NT in the sheet-transport direction. The transport roller pair 522R causes the timing at which the toner image on the transfer belt 31 is moved to the transfer nip NT to match the timing at which the sheet P is transported to the transfer nip NT.

The medium feeding portion 52 also includes an auxiliary transport path 52Pr. The auxiliary transport path 522Pr extends from an opening 91W, which is formed in a side surface of the first housing 91 opposite to a side surface adjacent to the second housing 92, and joins the turning portion 52P2 of the medium feeding path 522. The auxiliary transport path 52Pr is used to feed a sheet P to the image forming section 12 when the sheet P is fed from an optional recording-medium feeding device (not shown), which is disposed adjacent to the opening 91W in the first housing 91.

Intermediate Transport Portion

As illustrated in FIG. 10, the intermediate transport portion 58 is disposed between the transfer nip NT of the transfer device 30 and the fixing nip NF of the fixing device 40. The intermediate transport portion 58 includes plural belt transport members 581 each having an endless transfer belt, which is looped over rollers.

Air is sucked from the inside of the belt transport member 581 so as to produce a negative air pressure that attracts the sheet P to the surface of the transfer belt. In this state, the transfer belt rotate, and thereby the intermediate transport portion 58 transports the sheet P.

Medium Output Portion

As illustrated in FIG. 11, the medium output portion 54 outputs the sheet P, to which the toner image has been fixed by the fixing device 40 of the image forming section 12, to the outside of the housing 90 through an output port 92W, which is formed in a side surface of the second housing 92 opposite to a side surface adjacent to the first housing 91.

The medium output portion 54 includes the medium output tray 541 for receiving the sheet P output from the output port 92W.

This medium output portion 54 has a medium output path 54P, along which the sheet P is transported from the fixing device 40 (fixing nip NF) to the output port 92W. The medium output path 54P is formed by a belt transport member 543, plural roller pairs 542, and guides (not shown). A roller pair 542E is one of the roller pairs 542 that is disposed on the most downstream side in the sheet-output direction. The roller pair 542E functions as an output roller that outputs the sheet P onto the medium output tray 541.

Medium Reversing Portion

The medium reversing portion 56 includes plural roller pairs 561. A reversing path 56P is formed by the roller pairs 561. A sheet P that has passed through the image inspection portion 66 is fed to the reversing path 56P when a duplex image-forming mode is selected. The reversing path 56P includes a branch path 56P1, a transport path 56P2, and a reversing path 56P3. The branch path 56P1 branches off from the medium output path 54P. The transport path 56P2 receives the sheet P from the branch path 56P1 and transports the sheet P to the medium feeding path 52P. The reversing path 56P3, which is provided in the transport path 56P2, reverses the direction in which the sheet P is transported along the transport path 56P2 (transports the sheet P in a switchback manner), thereby flipping the sheet P over.

Postprocessing Section

The postprocessing section 60 includes the medium cooling portion 62, the decurling device 64, and the image inspection portion 66, which are arranged in this order from the upstream side in the sheet-output direction along a portion of the medium output path 54P of the medium output portion 54, the portion being located on the upstream side of the branching portion of the branch path 56P1 in the sheet-output direction.

Medium Cooling Portion

The medium cooling portion 62 includes a heat absorbing device 621 that absorbs heat of the sheet P and a pressing device 622 that presses the sheet P against the heat absorbing device 621. The heat absorbing device 621 is disposed above the medium output path 54P, and the pressing device 622 is disposed below the medium output path 54P.

The heat absorbing device 621 includes a heat-absorbing belt 6211 that is an endless belt, plural rollers 6212 that support the heat-absorbing belt 6211, a heat sink 6213 disposed inside the loop of the heat-absorbing belt 6211, and a fan 6214 for cooling the heat sink 6213.

The outer peripheral surface of the heat-absorbing belt 6211 is in contact with the sheet P so that heat of the sheet P may be transferred to the heat-absorbing belt 6211. A roller 6212D, which is one of the rollers 6212, functions as a driving roller that transmits a driving force to the heat-absorbing belt 6211. The heat sink 6213 is in surface-contact with a predetermined portion of the inner peripheral surface of the heat-absorbing belt 6211 extending along the medium output path 54P, and the heat-absorbing belt 6211 is slidable over the predetermined portion.

The pressing device 622 includes a pressing belt 6221, which is an endless belt, and plural rollers 6222 that support the pressing belt 6221. The pressing belt 6221 is looped over the rollers 6222. The pressing device 622 presses the sheet P against the heat-absorbing belt 6211 (the heat sink 6213) and transports the sheet P in cooperation with the heat-absorbing belt 6211.

Decurling Device

The decurling device 64 is provided on the downstream side of the medium cooling portion 62 in the medium output portion 54. The decurling device 64 decurls the sheet P received from the medium cooling portion 62.

Image Inspection Portion

An in-line sensor 661 of the image inspection portion 66 is disposed on the downstream side of the decurling device 64 in the medium output portion 54. The in-line sensor 661 irradiates the sheet P with light and, on the basis of light reflected from the sheet P, detects the presence of a defect of a fixed tone image (and if present, the severity of the defect), such as nonuniform toner density, an image defect, a positional defect, or the like of a fixed toner image.

Image Forming Operation of Image Forming Apparatus

Next, the outline of an image forming operation performed on a sheet P by the image forming apparatus 10 and a post-processing operation will be described.

As illustrated in FIG. 11, upon receiving an image forming command, the controller 70 activates the toner-image forming portions 20, the transfer device 30, and the fixing device 40. Thus, as illustrated in FIG. 10, the photoconductor drums 21 of the image forming units 14 corresponding to the respective colors and a development roller 242 of the developing device 24 are rotated, and therefore the transfer belt 31 is rotated. Furthermore, the pressure roller 42 is rotated, and the fixing belt 411 is rotated. In synchronization with the rotations of these rollers and belts, the controller 70 activates the medium transport device 50 and other components.

The chargers 22 charge the photoconductor drums 21 for different colors while the photoconductor drums 21 are rotated. The controller 70 sends image data, which have been processed by the image signal processor, to the exposure devices 23. The exposure devices 23 emit light beams L to the charged photoconductor drums 21 in accordance with the image data. As a result, electrostatic latent images are formed on the surfaces of the photoconductor drums 21. The developing devices 24 develop the electrostatic latent images on the photoconductor drums 21 by using a developer. Thus, toner images of the first special color (V), the second special color (W), yellow (Y), magenta (M), cyan (C), and black (K) are formed on corresponding photoconductor drums 21.

The color toner images formed on the photoconductor drums 21 are successively transferred to the rotating transfer belt 31 because the transfer bias voltage is applied to the first-transfer rollers 33. As a result, an overlapping toner image, in which toner images of six colors overlap each other, is formed on the transfer belt 31. The overlapping toner image is transported to the transfer nip NT as the transfer belt 31 rotates.

As illustrated in FIG. 11, the sheet P is fed to the transfer nip NT by the transport roller pair 522R of the medium feeding portion 52 at the same time as the overlapping toner image is transported to the transfer nip NT. Because a transfer bias voltage is applied to the second-transfer roller 34 at the transfer nip NT, the overlapping toner image is transferred from the transfer belt 31 to the sheet P.

The intermediate transport portion 58 transports the sheet P, to which the toner image has been transferred, from the transfer nip NT of the transfer device 30 to the fixing nip NF of the fixing device 40. The fixing device 40 applies heat and pressure to the sheet P passing through the fixing nip NF. Thus, the toner image on the sheet P is fixed to the sheet P.

The sheet P, which has passed through the fixing device 40, is transported by the medium output portion 54 to the medium output tray 541 outside the device. During this time, the postprocessing section 60 performs a postprocessing operation as follows. First, the medium cooling portion 62 cools the sheet P, which has been heated in the fixing process. Then, the decurling device 64 decurls the sheet P. Then, the image inspection portion 66 inspects the toner image fixed to the sheet P in order to detect the presence of a defect of the fixed toner image (and if present, the severity of the defect), such as nonuniform toner density, an image defect, a positional defect, or the like of a fixed toner image. Subsequently, the sheet P is output to the medium output portion 54.

When forming an image on a surface of the sheet P on which the image has not been formed (when performing a duplex image-forming operation), the controller 70 switches the transport path for the sheet P, which has passing through the image inspection portion 66, from the medium output path 54P of the medium output portion 54 to the branch path 56P1 of the medium reversing portion 56. As a result, the sheet P is flipped over as the sheet P passes through the reversing path 56P and is fed to the medium feeding path 52P. An image is formed (and fixed) on the back surface of the sheet P through an image forming process the same as that performed on the front surface. An operation the same as that described above is performed on the back surface of the sheet P after an image has been formed on the front surface is performed. Then, the medium output portion 54 outputs the sheet to the medium output tray 541 outside the device.

Structure of Exposure Device

Next, the exposure device 23 will be described.

Figure 8:
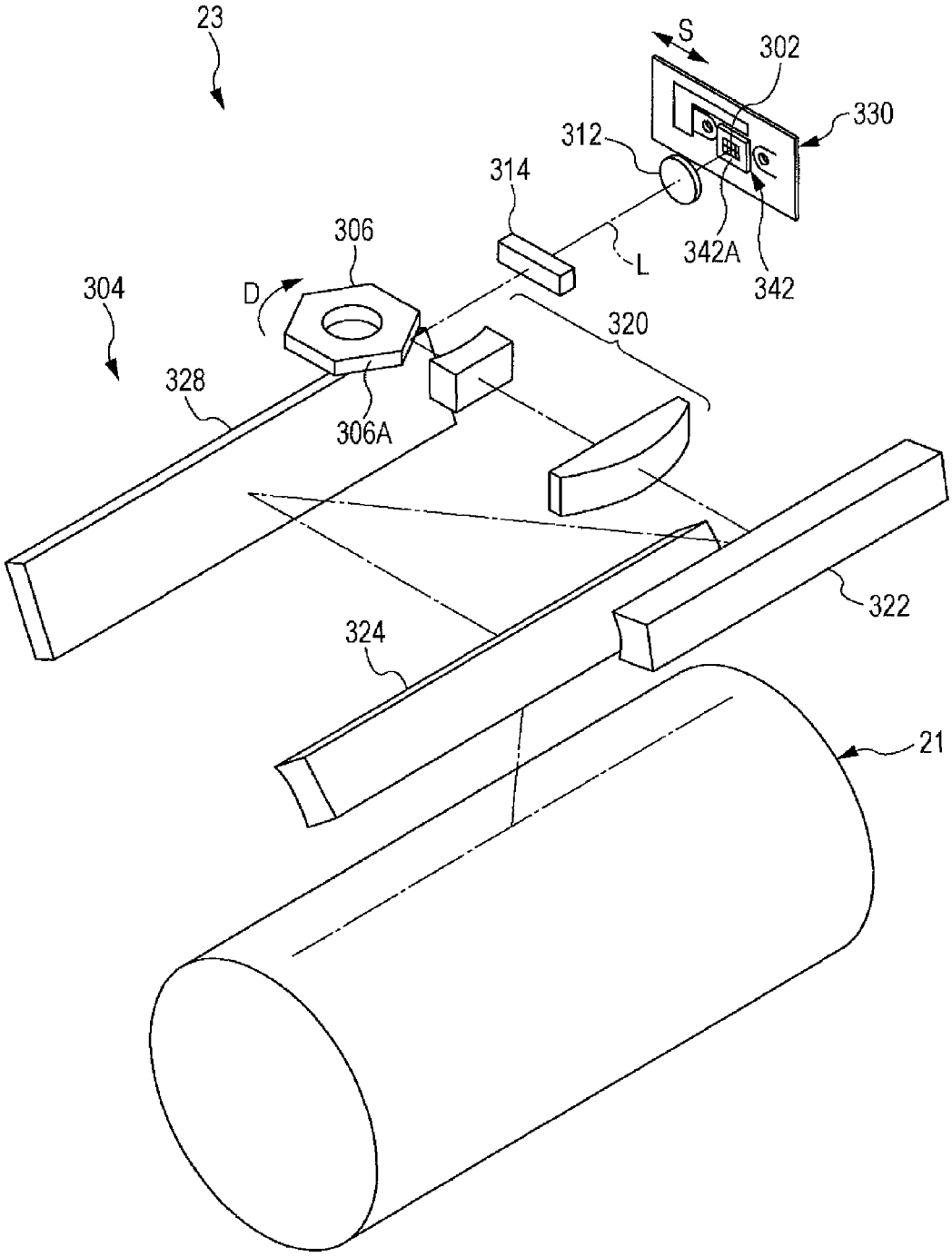
FIG. 8 is a perspective view illustrating the optical structure of the exposure device according to the exemplary embodiment of the present invention.

As illustrated in FIG. 8, the exposure device 23 includes a printed circuit board 330 (hereinafter simply referred to as "circuit board 330"). The circuit board 330 is attached to a housing 23A (see FIG. 9) of the exposure device 23, and a light source 302 for emitting plural light beams L is mounted on the circuit board 330. The circuit board 330 is an example of a board. A polygon mirror 306 is disposed between the light source 302 on the circuit board 330 and the photoconductor drum 21, which is irradiated with the light beams L. The polygon mirror 306 is a component of an optical system 304 for deflecting and guiding the light beams L emitted from the light source 302.

Figure 6:
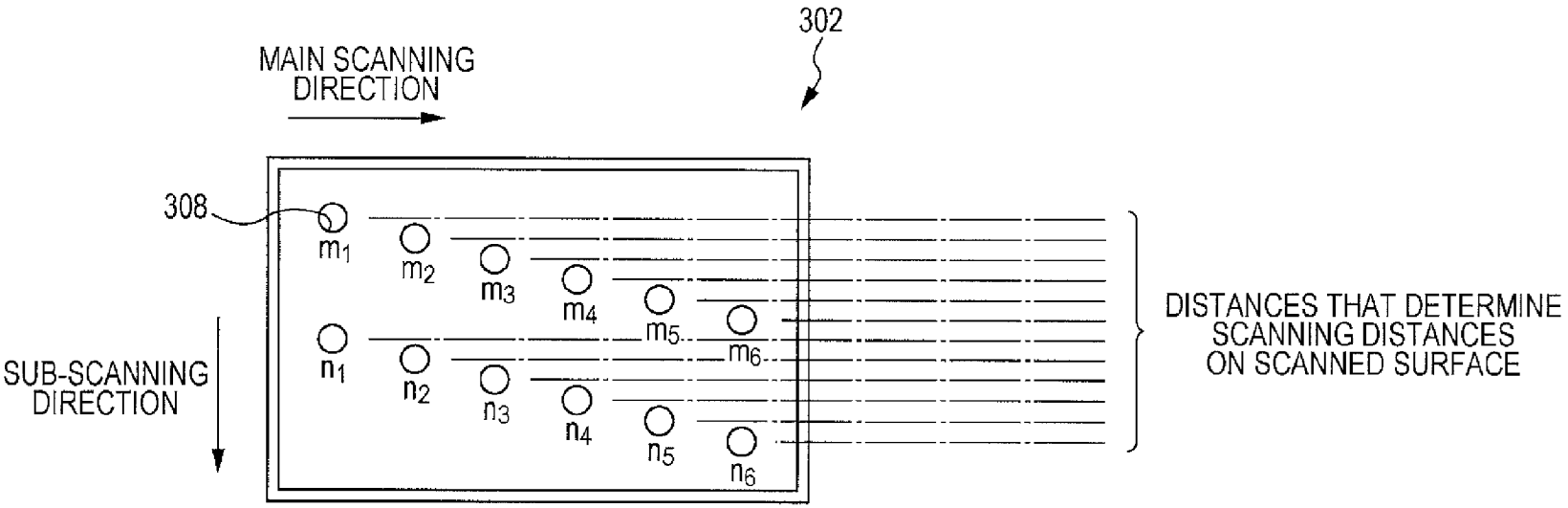
FIG. 6 is a schematic view of the light source of the exposure device according to the exemplary embodiment of the present invention.

As illustrated in FIG. 6, the light source 302 is a surface emitting laser (so-called "VCSEL") having plural emission points 308 for emitting the light beams L. To be specific, in the light source 302, the emission points 308 are arranged two-dimensionally. For example, the light source 302 has two sets of emission points 308, each set including six emission points 305 arranged along a straight line. The arrangement of the emission points 308 is adjusted so that light beams L are emitted to points that are separated from each other along straight lines having predetermined angles with respect to the main scanning direction and the sub-scanning direction. The light beams L, which have been modulated, are emitted from the emission points 308, and the light beams L scan along scan lines that are different from each other with respect to the sub-scanning direction. The details of the light source 302 and the circuit board 330 will be described below.

As illustrated in FIG. 8, the polygon mirror 306 is a rotary body having a regular polygonal prism shape (in the present exemplary embodiment, a regular hexagonal prism shape). The polygon mirror 306 has six reflection surfaces 306A on sides thereof and rotates in the direction of an arrow D around the axis of the regular hexagon as the polygon mirror 306 is driven by a motor (not shown).

The light beams L (only one of which is shown in FIG. 8) emitted from the light source 302 are incident on the reflection surfaces 306A. As the polygon mirror 306 rotates, the incident angles of the light beams L on the reflection surfaces 306A continuously change, and therefore the light beams L are deflected by the reflection surfaces 306A. Thus, the light beams L simultaneously scan the outer peripheral surface (exposure surface) of the photoconductor drum 21 in the main scanning direction (axial direction of the photoconductor drum 21).

A collimator lens 312 and a cylindrical lens 314 are arranged in this order along an optical path extending from the light source 302 to the polygon mirror 306. The collimator lens 312 and the cylindrical lens 314 constitute the optical system 304 described above. The collimator lens 312 converts the light beams L, which are divergent when emitted from the emission points 308, into parallel beams. The cylindrical lens 314 makes the light beams L converge in the sub-scanning direction and directs the light beams L toward the polygon mirror 306.

Figure 7:
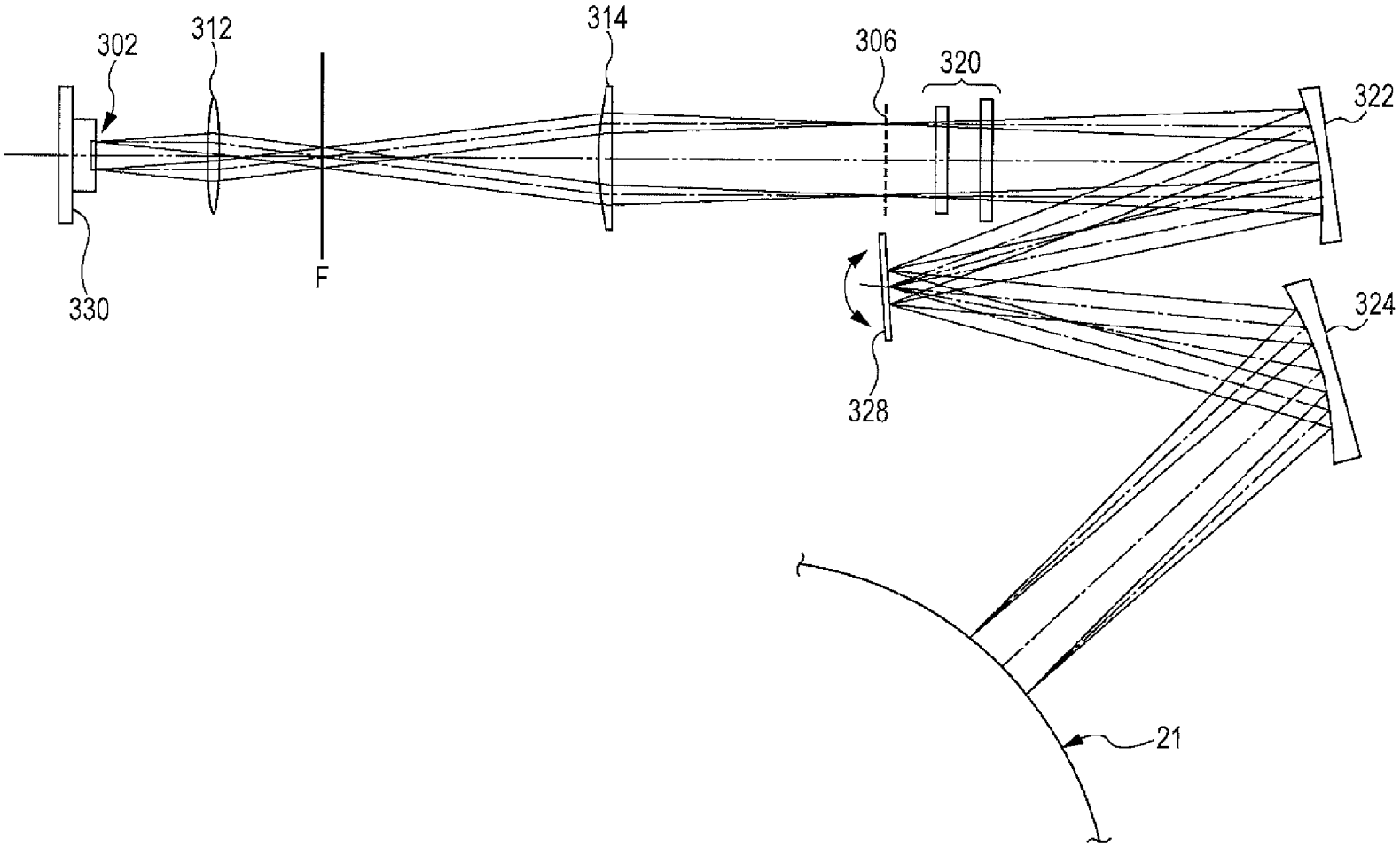
FIG. 7 is a schematic view illustrating the optical structure of the exposure device according to the exemplary embodiment of the present invention.

In other words, the light beams L emitted from the light source 302 become parallel beams when the light beams L pass through the collimator lens 312, and the light beams L converge at a focal point F, which is located downstream of the collimator lens 312 along the optical path, so as to intersect each other (see FIG. 7).

As illustrated in FIG. 8, a pair of fθ lenses 320 are disposed on the downstream side of the polygon mirror 306 along the optical path. The fθ lenses 320 have an optical power that gathers the light beams L only in the main scanning direction. Moreover, the fθ lenses 320 cause the light beams L to scan the outer peripheral surface of the photoconductor drum 21 at the same scanning speed in the main scanning direction. A first cylindrical mirror 322 and a second cylindrical mirror 324 are disposed on the downstream side of the fθ lenses 320 along the optical path. The first cylindrical mirror 322 and the second cylindrical mirror 324 cause the light beams L to converge in the sub-scanning direction.

A reflection mirror 328 is disposed in an optical path between the first cylindrical mirror 322 and the second cylindrical mirror 324. The reflection mirror 328 adjusts the angles at which the light beams L are incident on the second cylindrical mirror 324 in the sub-scanning direction.

To be specific, the pair of fθ lenses 320 adjust the light beams L, which have been deflected by the polygon mirror 306, so that the light beams L scan the outer peripheral surface of the photoconductor drum 21 at the same scanning speed.

The first cylindrical mirror 322 and the second cylindrical mirror 324, which have a power for gathering light in the sub-scanning direction, direct the light beams L toward the photoconductor drum 21 and focus the light beams L on the outer peripheral surface of the photoconductor drum 21.

The first cylindrical mirror 322 and the second cylindrical mirror 324 are disposed so that the optical-side focal point of the first cylindrical mirror 322 and the image-side focal point of the second cylindrical mirror 324 coincide with each other (in other words, so that the optical path length between the first cylindrical mirror 322 and the second cylindrical mirror 324 is the same as the sum of the focal length of the first cylindrical mirror 322 and the focal length of the second cylindrical mirror 324). Thus, the positions of the reflection surfaces 306A of the polygon mirror 306 and the positions on the outer peripheral surface of the photoconductor drum 21, which is to be scanned by the laser beams L, have a relationship that is afocal and conjugate in the sub-scanning direction.

Light Source and Circuit Board

Next, the light source 302, the circuit board 330, and related components will be described in detail.

As illustrated in FIG. 8, the light source 302, which emits the light beams L, are held by a holder 342 having a rectangular plate-like shape. The holder 342 holding the light source 302 is mounted on the circuit board 330. The circuit board 330 has a rectangular shape extending in the main scanning direction (in the direction of an arrow S in FIG. 8). The holder 342 is mounted on a portion of the circuit board 330 on one side in the main scanning direction (the right side in FIG. 8). The holder 342 has a positioning surface 342A, which is flat. The positioning surface 342A surrounds the light source 302 and faces in the direction in which the light beams L are emitted. The positioning surface 342A is an example of a reference portion.

Figure 1:
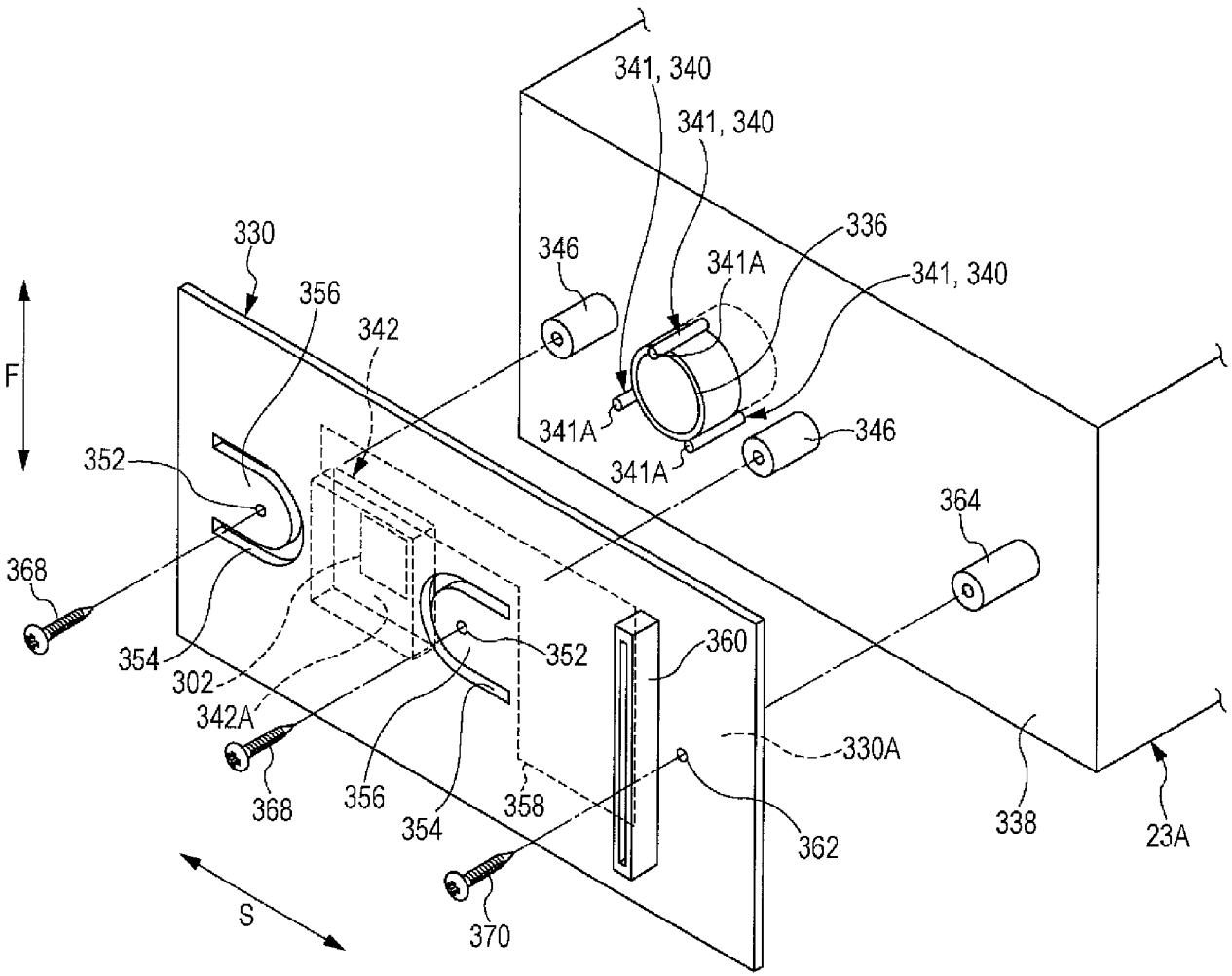
FIG. 1 is a partial exploded perspective view of an exposure device according to an exemplary embodiment of the present invention, illustrating a portion of the exposure device in which a light source is attached to a housing.
Figure 2:
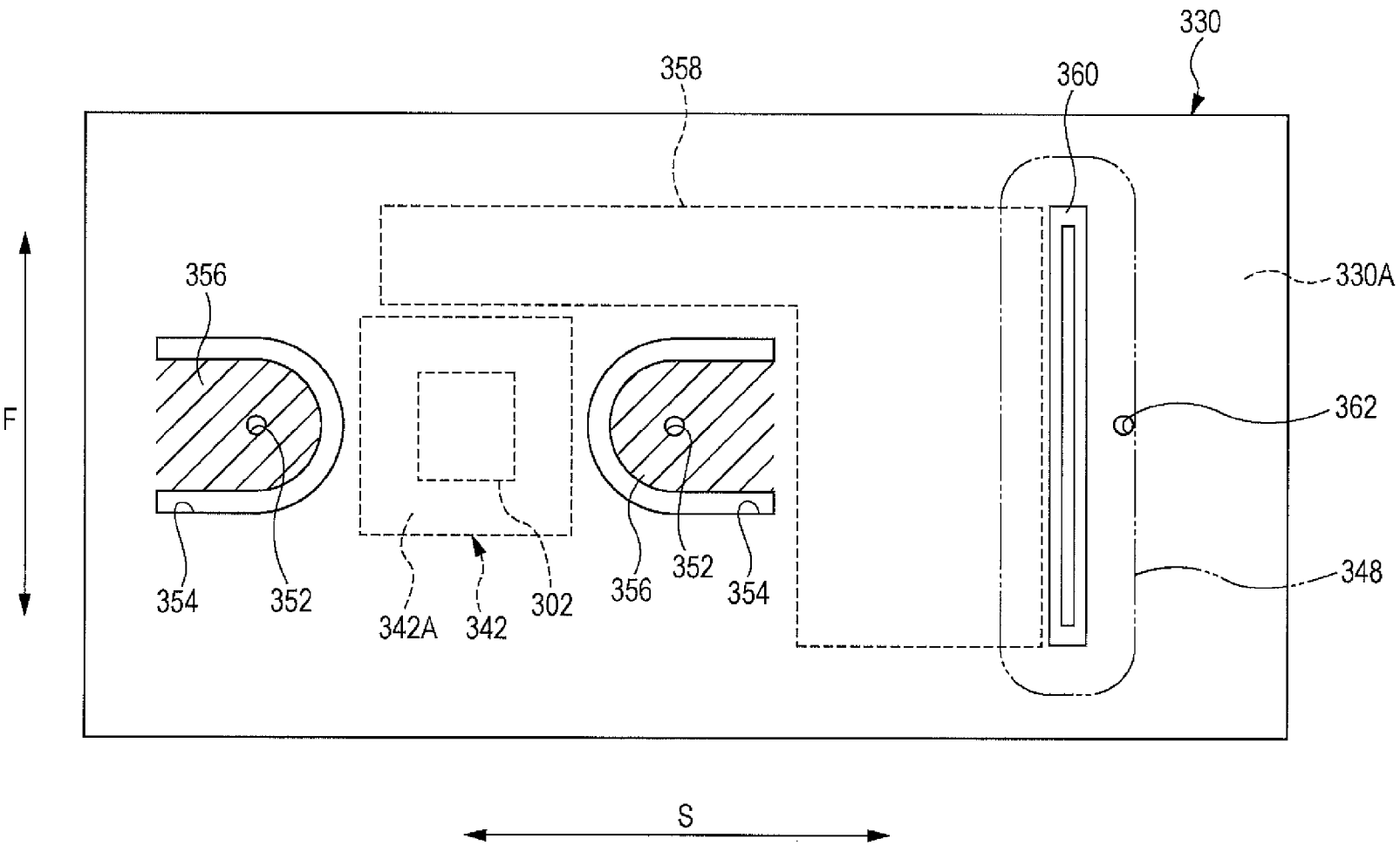
FIG. 2 is a plan view of a circuit board of the exposure device according to the exemplary embodiment of the present invention.

As illustrated in FIGS. 1 and 2, attachment holes 352 are formed in the circuit board 330 on both sides of the holder 342 in the main scanning direction. The attachment holes 352 are used to attach the circuit board 330 to the housing 23A of the exposure device 23. The circuit board 330 has U-shaped cutout portions 354 each surrounding a corresponding one of the attachment holes 352. To be specific, the cutout portions 354 having U-shapes are formed in the circuit board 330 so that the vertices of the cutout portions 354 face each other.

Deformable portions 356 (described below in detail) are portions of the circuit board 330 surrounded by the cutout portions 354 (which are hatched in FIG. 2). When the circuit board 330 is attached to the housing 23A, the deformable portions 356 become elastically deformed and generate restoring forces with which the deformable portions 356 urge the positioning surface 342A against a positioning member 340 (as described below in detail). A circuit 358 is disposed on a region of the circuit board 330 that is different from a region in which the deformable portions 356 are disposed.

A connector 360 is attached to a portion of the circuit board 330 on the other side in the main scanning direction (the right side in FIGS. 1 and 2). The connector 360, which is an example of a connection member, is connectable to another connection member (not shown), which is, for example, a connector of a flexible printed circuit board. The connector 360 is attached to a surface of the circuit board 330 that is opposite to a mounting surface 330A on which the holder 342 is mounted. The connector 360 has a rectangular-parallelepiped shape extending in the sub-scanning direction the direction of an arrow F in FIG. 2).

An attachment hole 362 is formed in the circuit board 330 at a position adjacent to the connector 360. The attachment hole 362 is used to attach the circuit board 330 to the housing 23A. The attachment hole 362 is an example of an attachment portion. To be specific, the attachment hole 362 has a circular shape and is disposed at a position that is opposite the holder 342 with the connector 360 therebetween. The attachment hole 362 is located inside of an offset line 348, which is an imaginary line on the circuit board 330 that surrounds the outer periphery of the connector 360 and that is separated from the outer periphery by 10 mm.

In other words, the phrase "a position adjacent to the connector 360" refers to a position in an area surrounded by the offset line 348 on the circuit board 330, which is an imaginary line that surrounds the outer periphery of the connector 360 and that is separated from the outer periphery by 10 mm.

Housing

Next, the housing 23A, to which the circuit board 330 is attached from the outside, will be described.

As illustrated in FIG. 1, a cylindrical portion 336 is disposed on a planar portion 338 of the housing 23A, which faces outward. The cylindrical portion 336 connects the outer space of the housing 23A to the inner space of the housing 23A. The light beams Z emitted from the light source 302 enter the housing 23A through the cylindrical portion 336.

The positioning member 340 is disposed so as to surround the cylindrical portion 336. The positioning member 340 positions the light source 302 in the optical axis direction by contacting the positioning surface 342A disposed around the light source 302.

The positioning member 340 includes three positioning portions 341. Each of the positioning portions 341 is a cylindrical body attached to the housing 23A and extending toward the circuit board 330. The positioning portions 341 are arranged in the circumferential direction of the cylindrical portion 336 at regular intervals. When the circuit board 330 is attached to the housing 23A, top surfaces 341A of the positioning portions 341 contact the positioning surface 342A.

Cylindrical bosses 346 are disposed on the planar portion 338 on both sides of the cylindrical portion 336 in the main scanning direction. The cylindrical bosses 346 face the deformable portions 356 of the circuit board 330 when the positioning surface 342A contacts the top surfaces 341A. A cylindrical boss 364 is disposed on the planar portion 338. The cylindrical boss 364 contacts the attachment hole 362 of the circuit board 330 when the positioning surface 342A contacts the top surfaces 341A (see FIG. 4).

Figure 3:
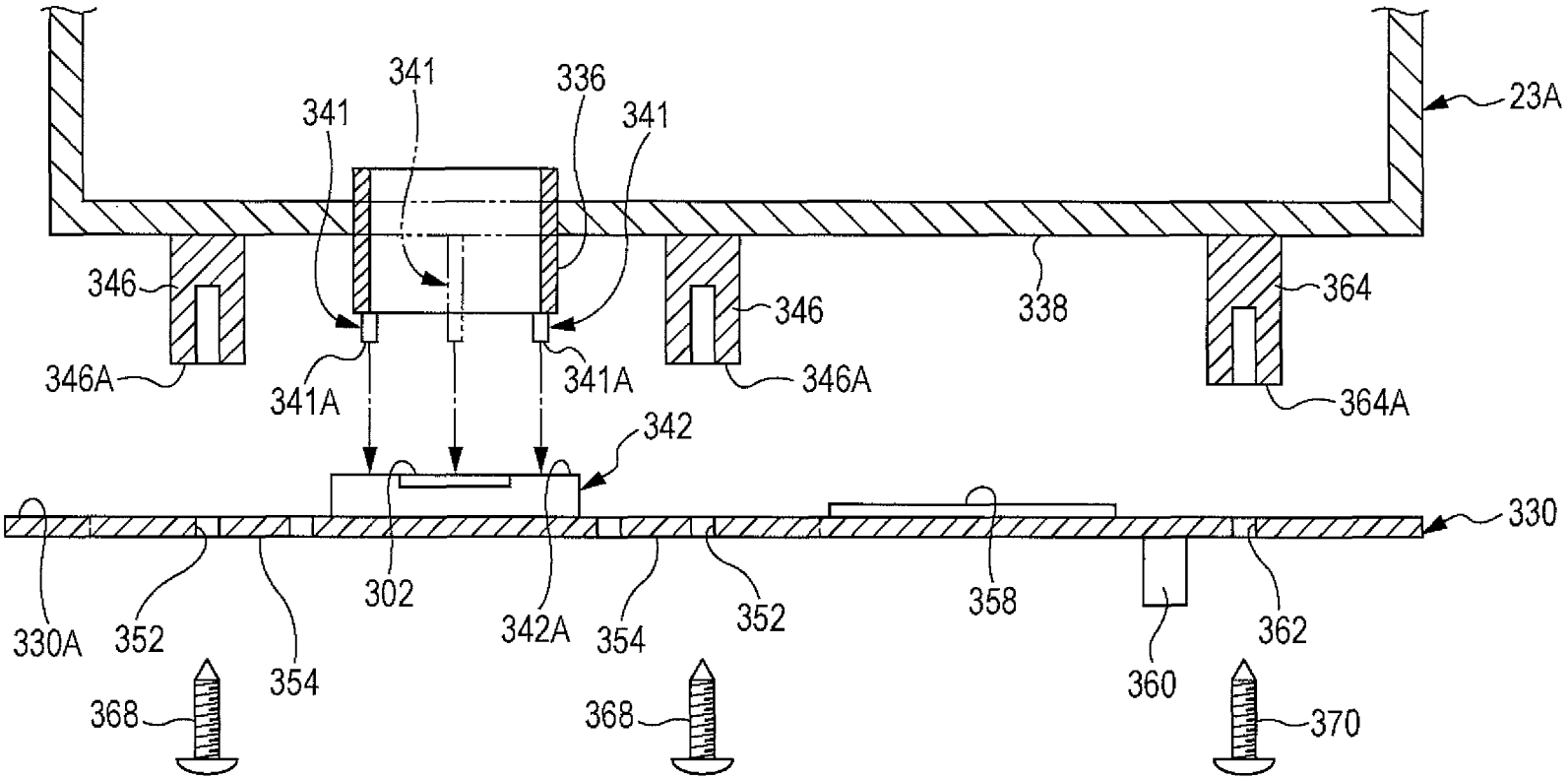
FIG. 3 is a partial sectional view of the exposure device according to the exemplary embodiment of the present invention, illustrating a portion of the exposure device in which the light source is attached to the housing.
Figure 4:
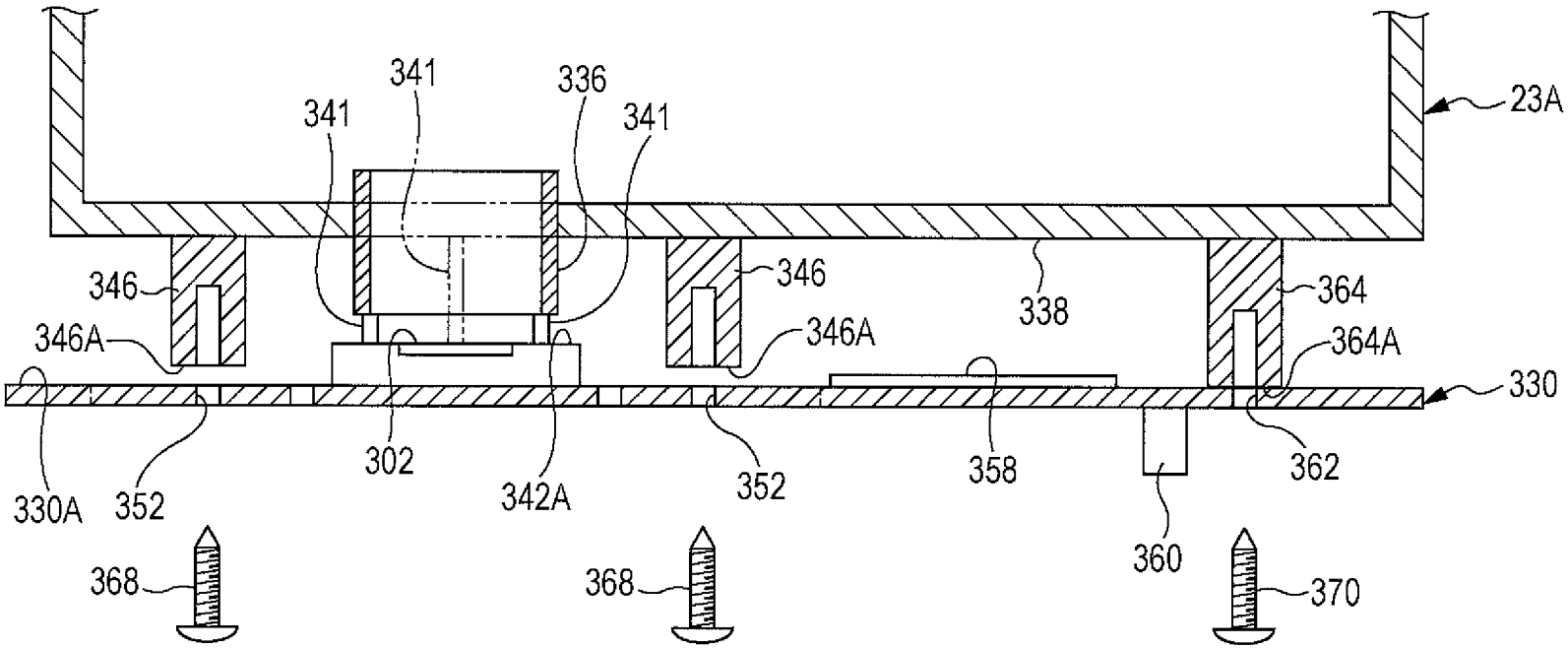
FIG. 4 is a partial sectional view of the exposure device according to the exemplary embodiment of the present invention, illustrating a portion of the exposure device in which the light source is attached to the housing.

To be specific, as illustrated in FIGS. 3 and 4, when the positioning surface 342A contacts the top surfaces 341A of the positioning portions 341 during the process of attaching the circuit board 330 to the housing 23A, gaps are formed between the mounting surface 330A, on which the holder 342 is mounted, and top surfaces 346A of the bosses 346. In this state, the mounting surface 330A contacts a top surface 364A of the boss 364.

Then, the circuit board 330 is attached to the housing 23A by inserting screws 368 into the attachment hole 352 and screwing the screws 368 into the bosses 346 and by inserting a screw 370 into the attachment hole 362 and screwing the screw 370 into the boss 364.

Figure 5:
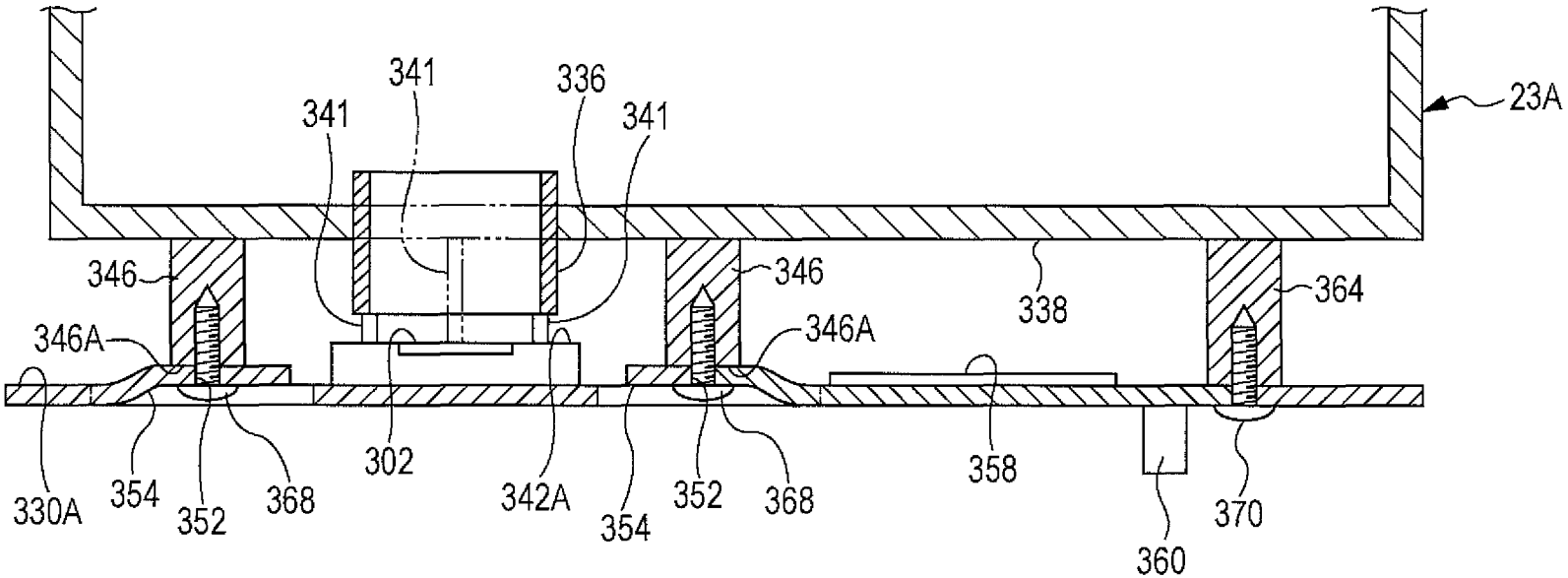
FIG. 5 is a partial sectional view of the exposure device according to the exemplary embodiment of the present invention, illustrating a portion of the exposure device in which the light source is attached to the housing.

As described above, when the positioning surfaces 342A contact the top surfaces 341A of the positioning portions 341, gaps are generated between the mounting surface 330A and the top surfaces 346A of the bosses 346. Therefore, as illustrated in FIG. 5, when the screws 368 are screwed into the bosses 346, the deformable portions 356 become elastically deformed and the top surfaces 346A of the bosses 346 contact the peripheries of the attachment holes 352.

CONCLUSION

The deformable portion 356 is elastically deformable, because U-shaped cutout portions surround the attachment holes 352 in the circuit board 330. When the deformable portions 356 become elastically deformed, restoration forces are generated, and the restoration forces urge the positioning surface 342A toward the top surfaces 341A of the positioning portions 341. The circuit 358 is disposed on a region of the circuit board 330 that is different from a region in which the deformable portions 356 are disposed. Therefore, as compared with a case where a circuit board is attached to a housing by using an independent attachment member while causing a circuit on the circuit to be deformed, it is possible to suppress damage to the circuit 358 on the circuit board 330 and it is possible to position the light source 302 with a higher accuracy relative to the housing 23A in the optical axis direction of the light source 302 by using a simple structure.

Because the light source 302 may be positioned with a higher accuracy in the optical axis direction, it is possible to form a toner image at a predetermined position on the outer peripheral surface of the photoconductor drum 21 (and therefore displacement of the image is suppressed).

The light source 302 is a surface emitting laser (so-called "VCSEL") having the plural emission points 308 for emitting the light beams L. Because the emission surface of the light source 302 is inclined, there is a difference (focus difference) between the optical path length from one of the emission points 308 located in one end portion of the light source 302 to the outer peripheral surface of the photoconductor drum 21 and the optical path length from one of the emission points 308 located at the other end portion to the outer peripheral surface of the photoconductor drum 21. However, as described above, because the accuracy of positioning of the light source 302 in the optical axis direction is increased, the inclination of the emission surface is reduced. As a result, it is possible to reduce the difference in the optical path length between the emission points to the outer peripheral surface of the photoconductor drum 21.

The position of the circuit board 330 may be changed when another connection member is connected to or disconnected from the connector 360. If the change in the position is not corrected, the emission points 308 may become inclined or may become displaced from desired positions. In this case, the emission surface of the light source 302 becomes inclined, and therefore a difference (focus difference) arises between the optical path length from one of the emission points 308 located in one end portion of the light source 302 to the outer peripheral surface of the photoconductor drum 21 and the optical path length from one of the emission points 308 located at the other end portion to the outer peripheral surface of the photoconductor drum 21. With the present embodiment, such a difference is suppressed, because the circuit board 330 is attached to the housing 23A by using the attachment hole 362 formed at a position adjacent to the connector 360.

The present invention is not limited to the exemplary embodiments described above. It is clear for a person having ordinary skill in the art that these exemplary embodiments may be modified in various ways within the spirit and scope of the present invention. For example, in the exemplary embodiments described above, the deformable portions 356 are formed by cutting the circuit board 330 in U-shapes. Alternatively, the deformable portions 356 may be formed by making the thicknesses of portions of the circuit board 330 be smaller than other portions.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure device comprising:

a board on which a light source for emitting a light beam is mounted and on which a circuit is disposed;

a housing that contains an optical system for guiding the light beam;

a positioning member that positions the light source relative to the housing in an optical axis direction by contacting a reference portion disposed around the light source; and a deformable portion disposed in a region of the board that is different from a region on which the circuit is disposed, the deformable portion urging the reference portion toward the positioning member by being elastically deformed when the board is attached to the housing, wherein the board has a U-shaped cutout portion, and wherein the deformable portion is surrounded by the cutout portion.

2. The exposure device according to claim 1, wherein a connection member connectable to another connection member is mounted on the board, and wherein the board includes an attachment portion with which the board is attached to the housing, the attachment portion being disposed at a position adjacent to the connection member.

3. The exposure device according to claim 2, wherein the light source is a surface emitting laser having a plurality of emission points each emitting a light beam.

4. The exposure device according to claim 1, wherein the light source is a surface emitting laser having a plurality of emission points each emitting a light beam.

5. An image forming apparatus comprising:

the exposure device according to claim 1;

an image carrier on which an electrostatic latent image is formed when the image carrier is irradiated with a light beam emitted from the exposure device; and a developing device that forms a visible toner image by developing the electrostatic latent image on the image carrier.

6. An exposure device comprising:

a board on which a light source for emitting a light beam is mounted and on which a circuit is disposed;

a housing that contains an optical system for guiding the light beam;

a positioning member that positions the light source relative to the housing in an optical axis direction by contacting a reference portion disposed around the light source; and a deformable portion disposed in a region of the board that is different from a region on which the circuit is disposed, the deformable portion urging the reference portion toward the positioning member by elastically deforming an inner portion of the board while edges of the board remain flat when the board is attached to the housing.

* * * * *